United States Patent [19]

Schinzel et al.

[11] Patent Number: 4,473,371

[45] Date of Patent: Sep. 25, 1984

[54] PERFLUOROALKYL ESTERS, A PROCESS FOR THEIR PREPARATION AND THEIR USE AS A SOIL-REPELLANT AGENT

[75] Inventors: Erich Schinzel; Emmerich Paszthory, both of Hofheim am Taunus, Fed. Rep. of Germany

[73] Assignee: Hoechst Aktiengesellschaft, Fed. Rep. of Germany

[21] Appl. No.: 412,127

[22] Filed: Aug. 27, 1982

[30] Foreign Application Priority Data

Sep. 4, 1981 [DE] Fed. Rep. of Germany ..... 3135012
Feb. 9, 1982 [DE] Fed. Rep. of Germany ..... 3204378

[51] Int. Cl.[3] ..... C07C 67/08; C07C 69/527; C07C 69/60

[52] U.S. Cl. ..... 8/115.5; 549/500; 549/501; 549/512; 549/513; 560/192; 560/193; 560/196; 560/197; 560/198; 560/199; 560/201; 560/204

[58] Field of Search ..... 549/512, 513, 500, 501; 560/192, 197, 198, 201, 193, 196, 199, 204; 8/115.5

[56] References Cited

U.S. PATENT DOCUMENTS 3,965,148 6/1976 Kleiner et al. ..... 560/197 X
4,316,986 2/1982 England et al. ..... 560/192 X
4,346,235 8/1982 Sonoda et al. ..... 560/192 X

FOREIGN PATENT DOCUMENTS 1094723 12/1967 United Kingdom .

*Primary Examiner*—Natalie Trousof
*Assistant Examiner*—Vera C. Clarke
*Attorney, Agent, or Firm*—Connolly and Hutz

[57] ABSTRACT

Perfluoroalkyl esters of the formula

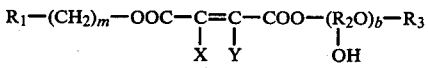

wherein $R_1$ denotes $C_2$–$C_{20}$, preferably $C_4$–$C_{14}$-perfluoroalkyl or perfluoroalkoxyperfluoroalkyl, $R_2$ denotes $C_3$–$C_4$-alkylene, $R_3$ denotes $C_2$–$C_5$-ω-epoxyalkyl or $C_1$–$C_{18}$, preferably $C_1$–$C_5$-alkyl, which can be substituted by 1 or 2 halogen atoms, preferably chlorine atoms, by hydroxyl groups, by a group of the formula

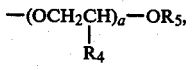

by 1 to 3 groups of the formula —OCO—CX=CY—COO—$(CH_2)_m$—$R_1$ or by, in each case, one lower alkoxy, epoxy, lower acyloxy, lower alkoxycarbonyl, lower acylamino, lower hydroxylalkylthio, lower trialkylamino, lower trialkylammonium, phenyl, phenoxy or furanyl group or $R_3$, in the case where b=0, also denotes $C_3$–$C_{18}$-alkenyl, which can be subsituted by hydroxyl groups or a phenyl group; $C_3$–$C_8$-alkynyl, which can be substituted by hydroxyl groups; cyclohexyl; phenyl, which can be substituted by 1–3 $C_1$–$C_8$-alkyl groups or by phenyl, or naphthyl, $R_4$ denotes hydrogen or methyl, $R_5$ denotes hydrogen or $C_1$–$C_4$-alkyl, X and Y denote hydrogen, halogen or $C_1$–$C_6$-alkyl, a denotes a number from 1 to 10, b denotes 0 or 1 and m denotes a number from 1 to 6, preferably 1 to 4, a process for their preparation and their use for providing oil and water-repellant finishing of textile material.

8 Claims, No Drawings

PERFLUOROALKYL ESTERS, A PROCESS FOR THEIR PREPARATION AND THEIR USE AS A SOIL-REPELLANT AGENT

The invention relates to perfluoroalkyl esters, which are suitable for soil-repellant finishing of fibers or fabrics of synthetic or semi-synthetic materials, preferably of polyethylene terephthalate or polyamides.

Compounds which contain perfluoroalkyl radicals are already known as soil-repellant agents. Thus, in German Offenlegungsschrift No. 2,628,776, compounds, which are essentially composed of at least one fluorinated compound having at least one benzene ring, are described. Furthermore, soil-repellant agents, which are composed of polymeric compounds containing fluorinated groups, are known. In particular, fluorinated compounds are described in U.S. Pat. No. 3,547,861, which relates to fluorinated acrylates and polyacrylates, wherein the fluorinated radical is derived from a fluorinated alcohol having a terminal fluorinated alkoxy group. Similar products, wherein the fluorinated radical of the polyacrylate is a straight-fluorinated alcohol, are likewise known for uses of this nature.

The compounds according to the invention correspond to the general formula (1)

$$R_1-(CH_2)_m-OOC-\underset{X}{\underset{|}{C}}=\underset{Y}{\underset{|}{C}}-COO-(\underset{OH}{\underset{|}{R_2O}})_b-R_3 \quad (1)$$

wherein $R_1$ denotes $C_2$–$C_{20}$, preferably $C_4$–$C_{14}$-perfluoroalkyl or perfluoroalkoxyperfluoroalkyl, $R_2$ denotes $C_3$–$C_4$-alkylene, $R_3$ denotes $C_2$–$C_5$-$\omega$-epoxyalkyl or $C_1$–$C_{18}$, preferably $C_1$–$C_5$-alkyl, which can be substituted by 1 or 2 halogen atoms, preferably chlorine atoms, by hydroxyl groups, by a group of the formula $$-(\underset{R_4}{\underset{|}{OCH_2CH}})_a-OR_5,$$

by 1 to 3 groups of the formula —OCO—CX=CY—COO—$(CH_2)_m$—$R_1$ or by, in each case, one lower alkoxy, epoxy, lower acyloxy, lower alkoxycarbonyl, lower acylamino, lower hydroxylalkylthio, lower trialkylamino, lower trialkylammonium, phenyl, phenoxy or furanyl group or $R_3$, in the case where b=0, also denotes $C_3$–$C_{18}$-alkenyl, which can be substituted by hydroxyl groups or a phenyl group; $C_3$–$C_8$-alkynyl, which can be substituted by hydroxyl groups; cyclohexyl phenyl, which can be substituted by 1–3 $C_1$–$C_8$-alkyl groups or by phenyl, or naphthyl, $R_4$ denotes hydrogen or methyl, $R_5$ denotes hydrogen or $C_1$–$C_4$-alkyl, X and Y denote hydrogen, halogen or $C_1$–$C_6$-alkyl, a denotes a number from 1 to 10, b denotes 0 or 1 and m denotes a number from 1 to 6, preferably 1 to 4.

The perfluoroalkyl esters of the formula (1) are preferred in which $R_1$ denotes a group of the formula $C_lF_{2l+1}$—, a group of the formula $H(C_2F_4)_n$— or a group of the formula $(CF_3)_2CFO(CF_2)_o$—, l denotes the numbers 6, 8, 10, 12 or 14, n denotes the numbers 1, 2, 3 and 4 and o denotes whole numbers from 2 to 8, b=0, $R_3$ denotes a straight-chain or branched $C_2$–$C_8$-alkyl, which can be substituted by hydroxyl groups, chlorine atoms, 1 to 3 groups of the formula —OCO—CX=CY—COO—$(CH_2)_m$—$R_1$ or the epoxide group, and X and Y denote hydrogen atoms, which are preferably arranged in trans-positions.

Among the meanings of $R_3$, the following groups are particularly interesting:

$$-CH_2\underset{OH}{\underset{|}{C}}HCH_2Cl,\ -CH_2\underset{OH}{\underset{|}{C}}HCH_2OH,\ -CH_2-\underset{O}{\underset{\diagdown\ \diagup}{CH}}-CH_2,$$

$$-CH_2-\underset{OH}{\underset{|}{CH}}-CH_2-,\ -CH_2\overset{CH_2}{\overset{|}{\underset{CH_2}{\underset{|}{C}}}}-\overset{OH}{\overset{|}{\underset{OH}{\underset{|}{CH_2}}}}OH \text{ or}$$

$$-CH_2-\overset{CH_2OH}{\overset{|}{\underset{CH_2OH}{\underset{|}{C}}}}-CH_2-.$$

The term "perfluoroalkyl" or "perfluoroalkoxy" not only comprises groups of these types having terminal —$CF_3$, but also those having terminal —$CF_2H$ groups. The term "lower" comprises groups of these types which contain 1 to 4 C atoms.

The perfluoroalkyl esters according to the invention are soil-repellant compounds which have a high repellant capacity towards water and oil and which remain on the fibers even after repeated washing and dry cleaning. A further advantage of the compounds according to the invention is that they can be applied in solution or as a dispersion to the synthetic fiber materials or can be incorporated by mixing with pellets of the thermoplastic and subsequent forming into fibers or threads. A particular advantage of the new soil-repellant agents is also that they permit satisfactory coloring of the fibers or threads into which these agents are incorporated. The new soil-repellant agents can also be applied together with a dyestuff from one bath with satisfactory results.

The preparation of the compounds (1) according to the invention is carried out by reacting a maleic anhydride with 1 mole of a perfluorinated alcohol or alkoxyalcohol of the formula $R_1$—$(CH_2)_m$OH, if appropriate in the presence of an inert organic solvent, such as dimethylformamide, N-methylpyrrolidone, hexamethylphosphoric triamide, tetramethylurea, toluene, chlorobenzene or dichlorobenzene, at temperatures from 30° to 130° C., preferably at 40° to 70° C. This reaction can be catalytically accelerated by the addition of a tert.-amine, such as triethylamine, N,N-dimethylaniline, pyridine or methylpyridine.

The perfluoroalkyl hemiesters of maleic acid and/or fumaric acid formed can be converted in a conventional manner, by rotation with phosphorus chlorides, phosgene or thionyl chloride, into the corresponding perfluoroalkyl hemiester chlorides of maleic and/or fumaric acid, which can be reacted with suitable alcohols, of the formula $$HO-(\underset{OH}{\underset{|}{R_2O}})_b-R_3,$$

advantageously in the presence of proton binders, such as tert.-amines, to give the compounds of the formula (1).

However, the perfluoroalkyl hemiesters of maleic acid and/or fumaric acid can also be reacted with epoxides, for example with ethylene oxide, propylene oxide or epichlorohydrin, the β-hydroxyalkyl esters being formed with opening of the 3-membered ring containing oxygen. This reaction is advantageously carried out with excess epoxide in the presence of an inert organic solvent at temperatures from 30° to 130° C., preferably at 40° to 70° C.

The basic esters obtained with aminoalcohols, such as dimethylaminoethanol, diethylaminoethanol or morpholinoethanol can be reacted further in inert organic solvents with alkylating agents, such as dimethyl sulfate, methyl p-toluenesulfonate or alkyl halides to give ammonium alkyl esters. These compounds are also obtained by heating halogenoalkyl esters, such as, for example, 3-chloro-2-hydroxypropyl ester, for several hours with tert.-amines, such as triethylamine.

Examples of compounds, to which the present invention relates, have the formulae:

$C_lF_{2l+1}CH_2CH_2OOC-CH=CH-CO- = A$
Cis and/or trans, l = 6, 8, 10, 12

$A-O-CH_2CH_2OH$, $A-O-CH_2-CH_2-O-A$, $A-O-CH_2CH_2-O-CO-CH_3$, $A-O-CH_2-CH(OH)-CH_2-O-A$, $A-O-CH_2-CH(OA)-CH_2-O-A$, $CH(CH_2-O-A)_3$ $A-O-CH_2-CH(OH)-CH_2-O-CH_2-CH(OH)-CH_2-OH$, $C(CH_2O-A)_4$, $A-O(CH_2)_4-CH(OH)-CH_2OH$ $H(C_2F_4)_nCH_2OOC-CH=CH-CO- = B$
Cis and/or trans, n = 1, 2, 3, 4

$B-OCH_2-CH_2-OH$, $B-O-CH_2-CH(OH)-CH_2-O-B$, $B-O-CH_2-CH(OB)-CH_2-O-B$ $B-O-CH_2-CH(OH)-CH_2-O-CH_2-CH(OH)-CH_2-OH$, $CH(CH_2-O-B)_3$, $C(CH_2-O-B)_4$ $B-O-(CH_2)_4-CH(OH)-CH_2OH$ $(CF_3)_2CFO(CF_2)_oCH_2CH_2OOC-CH=CH-CO- = D$
Cis and/or trans, o = 2 to 8

$D-O-CH_2CH_2OH$, $D-OCH_2CH_2O-D$, $D-O-CH_2CH_2OCOC_2H_5$, $D-O-CH_2-CH(OH)-CH_2-O-D$, $D-O-CH_2-CH(OD)-CH_2-O-D$, $CH(CH_2-O-D)_3$ $C(CH_2OD)_4$, $D-O-(CH_2)_4-CH(OH)-CH_2OH$,

-continued $D-O-CH_2-CH(OH)-CH_2-O-CH_2-CH(OH)-CH_2OH$

Compounds of the present invention, which are particularly effective, correspond to the formulae below:

$A-O-CH_2-CH(OH)-CH_2Cl$, $A-O-CH_2-CH(OH)-CH-CH_2-OH$, $A-O-CH_2-CH-CH_2$ (O)

$B-O-CH_2-CH(OH)-CH_2Cl$, $B-O-CH_2-CH(OH)-CH_2-OH$, $B-O-CH_2-CH-CH_2$ (O)

$D-O-CH_2-CH(OH)-CH_2Cl$, $D-O-CH_2CH(OH)-CH_2-OH$, $D-O-CH_2-CH-CH_2$ (O)

The compounds of the formula (1) according to the invention are suitable for the simultaneous provision of water-repellant and oil-repellant finishes on synthetic and natural fibers and fabrics, especially for polyester, polyamide and polyacrylonitrile. Application of these compounds to the textile material is carried out by known processes by impregnation with a solution of the compounds of the formula (1) in a suitable organic solvent, preferably in acetone or dimethylformamide. However, the compounds of the formula (1) can also be employed in the form of aqueous dispersions. After impregnation, the textile material is squeezed out, dried and subjected to heat setting. It is particularly preferable that the compounds of the formula (1) are also used at the same time in a customary fiber finishing agent. The amount of the compounds (1) attached to the textile material is generally 0.05 to 1, preferably 0.1 to 0.4, % by weight of fluorine, calculated from the fluorine content of the compounds of the formula (1) and relative to the fiber weight.

It is assumed that the soil-repellant properties are conferred on the thermoplastic by the present compounds of the formula (1) because of their properties of decreasing the surface energy of the thermoplasts. This effect can be improved by heat-treatment at temperatures above the glass temperature of the thermoplasts and below the decomposition temperature of both the thermoplasts and also the soil-repellant agent. Suitable times for a heat-treatment of this type are in the range from about 5 to 240 minutes. Typical temperatures for the heat-treatment are about 100° to 220° C.

A further improvement in the effects of the present soil-repellant agents, which contain a hydroxyl group in the esterified radical, is obtained by using a bifunctional or trifunctional epoxide or isocyanate in the liquid medium, which contains the soil-repellant agent and in which the fiber or the other thermoplastic item is immersed or with which these are sprayed or otherwise treated, together with a catalyst, such as an amine, in order to promote the reaction of the hydroxyl group with an epoxide group or isocyanate group in the subsequent heat-treatment.

EXAMPLE 1

19.6 g of maleic anhydride were dissolved in 150 g of dimethylformamide, and 101.5 g of a telomeric alcohol of the formula $C_lF_{21+l}CH_2CH_2OH$, l=6, 8, 10 or 12 (OH number 110.6 mg of KOH) are added. The mixture was heated to 50° to 60°, with stirring, and maintained at this temperature for 7½ hours. After this reaction time, according to gas chromatographic determination, the telomeric alcohol had been consumed, apart from about 2% remaining.

The clear red-brown solution obtained was introduced into 750 ml of water, with stirring, and stirred for 30 minutes. The precipitate was allowed to settle out, the supernatant water was poured off and this washing procedure was repeated a further three times. The brownish resinous hemiester of maleic/fumaric acid had the expected equivalent weight after drying at 110° in vacuo.

Yield: 78 g $$C_lF_{21+l}CH_2CH_2OOC-CH=CH-COOH \quad (101)$$

l=6, 8, 10, 12; molecular weight 550

EXAMPLE 2

19.6 g of maleic anhydride were reacted with the telomeric alcohol in dimethylformamide as indicated in Example 1 to give the hemiester of maleic acid. The clear red-brown solution obtained was cooled down to 8° and, with stirring, 26.4 g of ethylene oxide were added. The temperature was allowed to rise to room temperature, the mixture was heated to 50° to 52° in about 3 hours and maintained at this temperature for 24 hours. The reaction mixture was then poured into 800 ml of water at 85°, the mixture was stirred for 25 minutes, allowed to settle out and the aqueous phase was decanted off. The water treatment was repeated another three to four times. Finally, water was removed from the light brown resinous reaction product by heating at 100° in vacuo. Yield: 84.7 g.

$$C_lF_{21+l}CH_2CH_2OOC-CH=CH-COOCH_2CH_2OH \quad (102)$$

l=6, 8, 10, 12; molecular weight 594.

Analysis: calculated F: 52.4%;
found F: 54.1%.

According to the NMR spectrum, (102) is composed of 90% of the diester of maleic acid and 10% of the diester of fumaric acid.

EXAMPLE 3

The process was carried out as indicated in Example 1 and, immediately after the 7½-hours of heating the maleic anhydride with the telomeric alcohol, 50 g of epichlorohydrin were allowed to run into the reaction solution, heated at 50° to 60°, within 30 minutes. The mixture was stirred at 50°-60° for a further 35 hours, the clear brown solution was poured into 1,000 ml of warm water, and the mixture was stirred, allowed to settle out and decanted off. This washing procedure was repeated a further three times and water was removed from the moist reaction product at 100° in vacuo. 80 g of the diester of the formula (103) below were obtained in the form of a brownish resin.

$$C_lF_{21+l}CH_2CH_2OOC-CH=CH-COOCH_2\underset{\underset{OH}{|}}{CH}CH_2Cl \quad (103)$$

l=6, 8, 10, 12; molecular weight 642.5.

Analyses: calculated F: 50.0%; Cl: 5.5%; found F: 50.2%; Cl: 4.8%.

According to NMR spectroscopy, (103) is composed of 62% of the diester of maleic acid and 38% of the diester of fumaric acid.

The iodine number of 40 and 41 g/100 g corresponds to a molecular weight of 627, whilst the molecular weight calculated, taking account of the composition of the telomeric alcohol, is 642.5.

EXAMPLE 4

The dimethylformamide solution of the hemiester prepared according to Example 1 was cooled down to 8° and 35.2 g of propylene oxide were added. The mixture was heated to 50° to 52° in 4 to 5 hours, with stirring, and maintained at this temperature for 36 hours. The working up was again carried out by stirring into water heated to 85°. After removing water at 80° to 90° in vacuo, 92.3 g of a light brown resin were obtained.

$$C_lF_{21+l}-CH_2CH_2OOC-CH=CH-COOCH_2-\underset{\underset{OH}{|}}{CH}-CH_3 \quad (104)$$

l=6, 8, 10, 12; molecular weight 608.

Analysis: calculated F: 51.1%; found F: 49.5% .

According to the NMR spectrum, (104) is composed of 87% of the diester of maleic acid and 13% of the diester of fumaric acid.

EXAMPLE 5

410.9 g of the hemiester (101) from Example 1 were stirred with 351 g of phosphorus oxychloride, with cooling. 157 g of phosphorus pentachloride were added in 15 minutes and the reaction mixture was stirred, conducting out hydrogen chloride, at 30°-35° for 6 hours and then at room temperature overnight. In order to complete the reaction, the mixture was heated a further 8 hours at 50°-60° until the evolution of HCl was virtually complete. Finally, phosphorus oxychloride was removed by distillation at 50° to 60° under waterpump vacuum. 423 g of a brown oil remained.

$$C_lF_{21+l}-CH_2CH_2OOC-CH=CH-COCl \quad (105)$$

l=6, 8, 10, 12; molecular weight 568.5.

Analysis: calculated Cl: 6.3%; found Cl: 6.9%

EXAMPLE 6

31 g of glycol were added dropwise to 56.2 g of the acid chloride (105), with stirring and cooling at 5° to 10°. At the same temperature, 18.7 g of pyridine were added dropwise in 30 minutes and the mixture was then heated to 50°-60° for 4 hours. After cooling down, the mixture was thoroughly stirred with 400 ml of water, after settling down, the water was decanted off and the washing procedure was repeated until chloride ions were no longer detectable. Water was removed from the resinous light brown reaction product by heating at 55°-60° in vacuo. Yield 43.2 g $$C_lF_{21+l}-CH_2CH_2OOC-CH=CH-COOCH_2CH_2OH \quad (106)$$

l=6, 8, 10, 12: molecular weight 594.

Analysis: calculated F: 52.4%; found F: 53.7%

EXAMPLE 7

56.2 g of the acid chloride (105) from Example 5 were dissolved in 150 ml of acetone, 3.1 g of glycol were added with stirring and the mixture was cooled to 0° to 5°. 12 g of pyridine were added dropwise in 15 minutes, the mixture was stirred in an ice bath for a further 30 minutes and allowed to warm to room temperature. The mixture was then heated under reflux for 3 hours, the acetone was removed by distillation under normal pressure and the brown resinous residue was stirred with water until chloride ions were no longer detectable. Water was removed from the product at 60° in vacuo. Yield: 76 g $$[C_lF_{21+l}-CH_2CH_2OOC-CH=CH-COO-CH_2-]_2 \quad (107)$$

l=6, 8, 10, 12, molecular weight 1126.

Analysis: calculated F: 56.0%; found F: 54.0%.

EXAMPLE 8

46 g of glycerol were added dropwise to 56.2 g of the acid chloride (105) from Example 5, at 5°-10° with stirring. At the same temperature, 15.8 g of pyridine were also added dropwise in 20 minutes and the mixture was allowed to warm to room temperature in about 2 hours. The mixture was then stirred a further 5 hours at 50°-60° and, after cooling down, thoroughly stirred with water until chloride ions were no longer detectable, and water was removed by subjecting the product to a good vacuum at 50°-60°. Yield: 52.8 g of brown resin.

$$C_lF_{21+l}-CH_2CH_2OOC-CH=CH-COOCH_2-\underset{\underset{OH}{|}}{CH}-CH_2OH \quad (108)$$

l=6, 8, 10, 12; molecular weight 624.

Analysis: calculated F (93% pure) 46.9%; found F: 45.1%; found $H_2O$ 7%.

According to the NMR spectrum (108) is composed of 98% of the trans-compound and 2% of the cis-compound.

EXAMPLE 9

4.6 g of glycerol were added to the solution of 56.2 g of the acid chloride (105) from Example 5 in 150 ml of acetone. 15.9 g of pyridine were added dropwise in the course of 15 minutes at 0°-5°, with stirring, and the mixture was kept in the ice bath for a further 30 minutes, at room temperature for 3 hours and then boiled under reflux for 3 hours. The acetone was removed by distillation under normal pressure and the resinous residue remaining was digested with water until chloride ions were no longer detectable. Finally, water was removed by heating at 60°-70° in vacuo. Yield: 41.3 g.

$$C_lF_{21+l}-CH_2CH_2OOC-CH=CH-COOCH_2-\underset{\underset{CHOH}{|}}{CH}-CH_2OH \quad (109)$$

l=6, 8, 10, 12; molecular weight 1156.

Analysis: calculated F: 51.3%; found F: 49.5%.

EXAMPLE 10

49.0 g of telomeric alcohol were added to the solution of 56.2 g of the acid chloride (105) from Example 5 in 150 ml of acetone, with stirring, and the mixture was cooled down to 0°-5°. 15.9 g of pyridine were added dropwise in the course of 15 minutes, the reaction mixture was stirred in the ice bath for a further 3 hours and then left at room temperature overnight. The mixture was then boiled under reflux for 3 hours and, after removing the acetone by distillation, worked up as usual. 71 g of a dark brown resin were obtained.

$$[C_lF_{21+l}-CH_2CH_2OOC-CH=]_2 \quad (110)$$

l=6, 8, 10, 12; molecular weight 984.

Analysis: calculated F: 64.2%; found F: 59.2%.

97% of trans-compound and 3% of cis-compound were found by NMR spectroscopy.

EXAMPLE 11

85.3 g of the acid chloride (105) from Example 5 were taken up in 150 ml of acetone and a mixture of 27.0 g of 1,4-butanediol, 13.3 ml of pyridine and 50 ml of acetone was added dropwise at a temperature below 30° in 75 minutes, with stirring. The yellowish suspension was then heated to boiling and boiled under reflux for 3 hours. The solvent was removed by distillation and the resinous residue was thoroughly stirred several times with 400 ml of warm water each time until chloride ions were no longer detectable. The residue, from which water had been removed, was dried to constant weight at 50° in vacuo. Yield: 82.3 g of yellowish wax.

$$C_lF_{21+l}CH_2CH_2OOC-CH=CH-COO(CH_2)_4OH \quad (111)$$

l=6, 8, 10, 12; molecular weight 622.1.

Analysis: calculated F: 50.1%; found F: 50.0%.

According to the NMR spectrum, the cis content is less than 1%.

EXAMPLE 12

31.2 g of 2,2-dimethyl-1,3-propanediol were dissolved in 50 ml of acetone, and 13.3 ml of pyridine were added. The acid chloride solution according to Example 11 was added dropwise at a temperature below 30° in 1 hour. The mixture was boiled under reflux for 3 hours and worked up as described in Example 11. Yield: 77.0 g of yellowish wax.

$$C_lF_{21+l}CH_2CH_2OOC-CH=CH-COOCH_2C(CH_3)_2CH_2OH \quad (112)$$

l=6, 8, 10, 12; molecular weight 636.1.

Analysis: calculated F: 48.9%; found F: 49.9%.

Only the trans-isomer was found by NMR spectroscopy.

EXAMPLE 13

24.1 g of 2-chloroethanol were dissolved in 50 ml of acetone, and 13.3 ml of pyridine were added. The acid chloride solution according to Example 11 was added dropwise at a temperature below 30° in 1½ hours. The mixture was stirred, boiling under reflux, for 3 hours, the solvent was removed by distillation and the residue was taken up in 200 ml of ethyl acetate. The organic phase was thoroughly stirred with portions of 200 ml of water until chloride ions were no longer detectable. The ethyl acetate solution was dried over sodium sulfate and evaporated to constant weight. 81.7 g of a brownish wax remained.

$$C_lF_{21+l}CH_2CH_2OOC—CH=CH—COOCH_2CH_2Cl \quad (113)$$

l=6, 8, 10, 12; molecular weight 612.5.

Analysis: calculated F: 50.9%; Cl: 5.9%; found F: 51.3%; Cl: 5.4%.

Only the trans-isomer was found by NMR spectroscopy.

EXAMPLE 14

19.4 g of 1,3-dichloro-2-propanol were dissolved in 50 ml of acetone, 13.3 ml of pyridine were added and the mixture was reacted with the acid chloride (105) as described in Example 11. Yield: 85.9 g of brown wax.

$$C_lF_{21+l}CH_2CH_2OOC—CH=CH—COO—CH(CH_2Cl)_2 \quad (114)$$

l=6, 8, 10, 12; molecular weight 661.0.

Analysis: calculated F: 47.1%; Cl: 10.9%; found F: 47.6%; Cl: 9.8%.

Only the trans-isomer was found by NMR spectroscopy.

EXAMPLE 15

31.2 g of glycol monoacetate were dissolved in 50 ml of acetone, 13.3 ml of pyridine were added and acylation was carried out with the acid chloride (105) as indicated in Example 11. 82.6 g of a brownish wax were obtained.

$$C_lF_{21+l}CH_2CH_2OOC—CH=CH—COOCH_2CH_2OCOCH_3 \quad (115)$$

l=6, 8, 10, 12; molecular weight 636.1.

Analysis: calculated F: 48.9%; found F: 49.9%.

PREPARATION EXAMPLES 16–54

TABLE

| Serial No. | Formula | $^1$H NMR cis/trans | Method | Yield | Analysis | % F | % Cl |
|---|---|---|---|---|---|---|---|
| 16 | A—OH | cis | A | 97.3% | calc. | 57.3 | — |
| | | | | | found | 58.0 | — |
| 17 | A—OH | trans | B | 90.4% | calc. | 57.3 | — |
| | | | | | found | 56.2 | — |
| 18 | A—Cl | trans | C | 100% | calc. | 49.2 | 6.4 |
| | | | | | found | 50.2 | 7.0 |
| 19 | A—$OCH_3$ | trans | D | 93.0% | calc. | 55.3 | — |
| | | cis <1% | | | found | 54.0 | — |
| 20 | A—$OCH(CH_3)_2$ | trans | D | 88.9% | calc. | 52.6 | — |
| | | cis <2% | | | found | 53.0 | — |
| 21 | A—O—$CH_2$—C($CH_2$)$_3$—$CH_3$ (C$_2$H$_5$) | trans | D | 84,9% | calc. | 42.2 | — |
| | | cis ca. 2% | | z | found | 43.5 | — |
| 22 | A—O($CH_2$)$_{17}$—$CH_3$ | trans | D | 90,4% | calc. | 38.6 | — |
| | | cis <2% | | | found | 37.0 | — |
| 23 | A—O—$CH_2$—CH=$CH_2$ | trans | D | 86,3% | calc. | 53.1 | — |
| | | cis <2% | | | found | 52.0 | — |
| 24 | A—O—($CH_2$)$_8$—CH=CH—($CH_2$)$_7$$CH_3$ | trans | D | 93,1% | calc. | 39.2 | — |
| | | cis <2% | | | found | 36.9 | — |
| 25 | A—O—$CH_2$—CH(OH)—$CH_2OH$ | trans 55% | E | 70,4% | calc. | 49.9 | — |
| | | cis <45% | | | found | 51.1 | — |
| 26 | A—O—$CH_2$C($CH_2OH$)$_2$$CH_2CH_3$ | trans | D | 90,2% | calc. | 46.9 | — |
| | | cis <1% | | | found | 47.9 | — |
| 27 | A—O—CH($CH_3$)—$CH_2$—C($CH_3$)$_2$(OH) | trans | D | 90,4% | calc. | 48.2 | — |
| | | cis <1% | | | found | 46.5 | — |
| 28 | A—O—$CH_2$—C($CH_2OH$)$_3$ | trans | D | 79,4% | calc. | 46.5 | — |
| | | cis <2% | | | found | 46.9 | — |
| 29 | A—O—$CH_2$—CH=CH—$CH_2OH$ | trans | D | 90.8% | calc. | 50.6 | — |
| | | cis <1% | | | found | 51.4 | — |
| 30 | A—O—C≡C—$CH_2OH$ | trans | D | 93.6% | calc. | 50.4 | — |
| | | cis <1% | | | found | 49.8 | — |
| 31 | A—O—$CH_2$CH(OH)—CH(OH)—CH(OH)—CH—$CH_2$—OH | trans | D | 75.6% | calc. | 43.9 | — |
| | | cis <1% | | | found | 44.4 | — |
| 32 | A—O—$CH_2$—CH(OH)—$CH_2Cl$ | trans | D | 88.9% | calc. | 48.8 | 5.5 |
| | | cis <1% | | | found | 50.4 | 6.0 |
| 33 | A—O—$CH_2$—$CH_2$—$OCH_3$ | trans | D | 90,1% | calc. | 51.2 | — |
| | | cis <1% | | | found | 51.6 | — |
| 34 | A—O—$CH_2CH_2OCH_2CH_2OCH_3$ | trans | D | 89.1% | calc. | 48.1 | — |
| | | cis <1% | | | found | 49.9 | — |
| 35 | A—(O—$CH_2CH_2$)$_4$OH | trans | D | 90.4% | calc. | 43.2 | — |
| | | cis <1% | | | found | 44.4 | — |

TABLE-continued

| Serial No. | Formula | $^1$H NMR cis/trans | Method | Yield | Analysis % F | Analysis % Cl |
|---|---|---|---|---|---|---|
| 36 | $A-O-\underset{\underset{CH_3}{\vert}}{CH}-CH_2OCH_2\underset{\underset{OH}{\vert}}{CH}-CH_3$ | trans<br>cis <1% | D | 86.5 | calc. 47.1<br>found 48.8 | —<br>— |
| 37 | $A-O-CH_2-\underset{\underset{OH}{\vert}}{CH}CH_2OCOCH_3$ | trans<br>cis <1% | D | 88,0% | calc. 47.1<br>found 49.0 | —<br>— |
| 38 | $A-O-CH_2-COOCH_3$ | trans<br>cis <1% | D | 94,1% | calc. 50.4<br>found 50.7 | —<br>— |
| 39 | $A-O-CH_2-COO(CH_2)_3CH_3$ | trans<br>cis <1% | D | 92,0% | calc. 47.2<br>found 47.3 | —<br>— |
| 40 | $A-O-CH_2CH_2HNCO(CH_2)_{16}CH_3$ | trans<br>cis <1% | D | 96,3% | calc. 36.5<br>found 35.6 | —<br>— |
| 41 | $A-O-CH_2CH_2-S-CH_2CH_2OH$ | trans<br>cis <1% | D | 81,9% | calc. 47.9<br>found 48.6 | —<br>— |
| 42 | 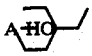 | trans<br>cis <1% | D | 89,4% | calc. 49.6<br>found 49.9 | —<br>— |
| 43 | 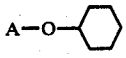 | trans<br>cis <1% | D | 90,8% | calc. 50.1<br>found 50.7 | —<br>— |
| 44 | 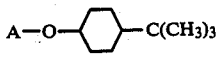 | trans<br>cis <1% | D | 88,7% | calc. 46.0<br>found 47.3 | —<br>— |
| 45 | 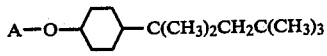 | trans<br>cis <1% | D | 94,6% | calc. 42.5<br>found 41.5 | —<br>— |
| 46 | 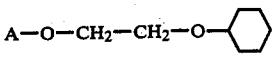 | trans<br>cis <1% | D | 91,2% | calc. 46.8<br>found 46.8 | —<br>— |
| 47 | 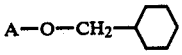 | trans<br>cis <1% | D | 90,1% | calc. 49.0<br>found 50.1 | —<br>— |
| 48 | 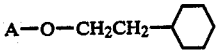 | trans<br>cis <1% | D | 90,5% | calc. 48.0<br>found 48.6 | —<br>— |
| 49 | 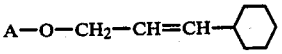 | trans<br>cis <1% | D | 94,8% | calc. 47.1<br>found 46.0 | —<br>— |
| 50 | 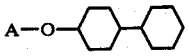 | trans<br>cis <1% | D | 92,3% | calc. 44.7<br>found 45.1 | —<br>— |
| 51 | 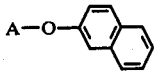 | trans<br>cis <1% | D | 94,5% | calc. 46.4<br>found 45.6 | —<br>— |
| 52 | 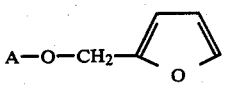 | trans<br>cis <1% | D | 90,7% | calc. 49.8<br>found 49.4 | —<br>— |
| 53 | $A-O-CH_2-\underset{\underset{OH}{\vert}}{CH}CH_2\overset{\oplus}{N}(CH_3)_3Cl^{\ominus}$ | — | F | 59,8% | calc. 44.3<br>found 43.5 | 5.1<br>5.0 |
| 54 | $A-O-CH_2\underset{\underset{OH}{\vert}}{CH}-CH_2\overset{\oplus}{N}(C_2H_5)_3Cl^{\ominus}$ | — | G | 73,7% | calc. 43.0<br>found 42.5 | 4.8<br>4.4 |

Method A 0.06 mole of triethylamine was added dropwise to a mixture of 1 mole of the perfluoroalkylalcohol $C_lF_{21+1}-CH_2CH_2OH$, $l=6$, 8, 10, 12, and 1 mole of maleic anhydride in toluene. The mixture was then heated to 50°-55° and stirred at this temperature for 6 hours. The precipitated hemiester was filtered off with suction at room temperature, washed 3 times with toluene and dried at 50° in vacuo. On titration in ethanol/-water against phenolphthalein, the expected equivalent weight was found (taking account of the triethylamine added).

Method B

An equal amount of water and the calculated amount of pyridine were added to the solution of the acid chloride from Example 18 in acetone, and the mixture was stirred at room temperature for 4 hours. After acidification with hydrochloric acid (1:1), a beige precipitate was obtained, which was stirred further, filtered off with suction, washed until free of Cl ions and dried at 60° in vacuo. Titration provided good values for the expected equivalent weight.

Method C

Thionyl chloride in toluene was initially introduced in about 20% excess and heated to 50°. At this temperature, the hemiester from Example 16 was introduced in about 2 hours and the clear colorless solution formed was stirred a further 10 hours at 50°. The reaction mixture was evaporated to constant weight at 50°-60° in vacuo.

Method D

The alcohol (when miscible with water, if appropriate, in up to 100% excess) in acetone with the calculated amount of pyridine was initially introduced and a solution of the acid chloride from Example 18 in acetone was added dropwise. The reaction mixture was boiled under reflux for 3 hours, the solvent was removed by distillation, the remaining, usually resinous, residue was thoroughly stirred several times with water (at 50°) until Cl ions were no longer detectable and dried at 50° in vacuo. When the separation from the aqueous phase proved to be difficult, the resinous reaction product was taken up in ethyl acetate, washed with water until free of ions, dried and evaporated.

Method E

Glycerol, in 100% excess, was added to the solution of the hemiester from Example 16 in dimethylformamide at room temperature, the mixture was heated to 50°-55° and left at this temperature for 22 hours until a sample, which had been removed and added to water, no longer consumed alkali. For working up, the mixture was added to water.

Method F

The hemiester from Example 16 was dissolved in dimethylformamide, the equimolar amount of glycidyltrimethylammonium chloride was added at 54° and the mixture was stirred a further 24 hours at this temperature. After cooling down to 20°, the mixture was filtered with suction, the filtered material was washed with dimethylformamide and the reaction product in the filtrate was precipitated with toluene. This was further stirred at 50°, decanted off, washed with toluene and dried at 50° in vacuo.

Method G

The 3-chloro-2-hydroxypropyl ester from Example 32 was dissolved in excess triethylamine and boiled under reflux for 48 hours. The amine was then removed by distillation in vacuo until the weight was constant.

Use Examples 5 g of compound (103) from Example 3 were dissolved in 1 liter of acetone. A polyamide fabric was impregnated with this solution with a pick-up of 40%. The amount of compound (103) attached to the fabric, relative to the content of fluorine, was 0.4% by weight. After the impregnation, the fabric was dried at 110° C. for 10 minutes and then subjected to heat setting at 180° C. for 30 seconds.

Testing the oil-repellant effect by the test method No. 118-1966 of the American Association of Textile Colorists and Chemists (AATCC) gave a value of 6 on the scale from 0 to 8. After washing three times in a washing machine at 40° C., the value measured by the same method was 5.

An equally good effect was obtained on impregnating a polyester fabric instead of the polyamide fabric with the compound (103).

A polyamide fabric was impregnated under the same conditions as mentioned above with a liquor composed of a solution of 5 g of the compound (104) from Example 4 in 1 liter of acetone. The heat setting in this case was carried out at 190° C. for 5 minutes.

In this case, the value of 5 was measured for the oil-repellant effect by AATCC No. 118-1966. After washing five times at 40° C., the value was still 4.

The compounds mentioned below were applied to a fabric composed of polyamide-6 filaments and polyester, using a padding mangle, with a liquor uptake of 40-50%. The amount of product was selected so that about 0.125% of fluorine was attached to the fabrics after drying. Solutions in acetone, which contained about 1.2 g of substance in 250 ml of acetone, were used. The following compounds according to the invention were employed:

| | |
|---|---|
| $C_lF_{2l+1}CH_2CH_2OOC—CH=CH—CO—A$<br>l = 6, 8, 10, 12; | |
| (1) A = $—O—CH_2—\underset{OH}{CH}—\underset{OH}{CH_2}$ | trans 55%<br>cis 45% |
| (2) A = wie (1); | trans 98%<br>cis 2% |
| (3) A = $—O—CH_2—\underset{CH_2OH}{\overset{CH_2OH}{C}}—CH_2—CH_3$ | trans<br>cis 1% |
| (4) A = $—O—CH_2—C(CH_2OH)_3$ | trans<br>cis <2% |
| (5) A = $—(O—CH_2CH_2)_4OH$ | trans<br>cis <2% |

The fabrics were air-dried in one case, condensed at 160° C. for 1 minute in one case and condensed at 160° C. for 30 minutes in one case. The oil-repellant values by the AATCC method were checked immediately (AN), and after 3 washings at the boiling temperature (3×BW) in a washing machine.

| | The following oil-repellant values were found: | | | | | | | | | |
|---|---|---|---|---|---|---|---|---|---|---|
| | Polyamide | | | | | Polyester | | | | |
| | | 1' at 160° C. | | 30' at 160° C. | | | 1' at 160° C. | | 30' at 160° C. | |
| | Air-dried | AN | 3 × BW | AN | 3 × BW | Air-dried | AN | 3 × BW | AN | 3 × BW |
| 1 | 6 | 6 | 6 | 6 | 6 | 6 | 6 | 6 | 6–7 | 6 |
| 2 | 6 | 5–6 | 5–6 | 6 | 6 | 6 | 6 | 6 | 6 | 6 |
| 3 | 5–6 | 6 | 5–6 | 5–6 | 5–6 | 5–6 | 5–6 | 6 | 6 | 6 |
| 4 | 6 | 6–7 | 6 | 6 | 6 | 6 | 6 | 6 | 6–7 | 6 |
| 5 | | | | | | 6 | 6 | 6 | 6 | 6 |

We claim:

1. A perfluoroalkyl ester of the formula (1)

$$R_1-(CH_2)_m-OOC-\underset{X}{C}=\underset{Y}{C}-COO-(\underset{OH}{R_2O})_b-R_3 \quad (1)$$

wherein $R_1$ denotes $C_2$–$C_{20}$-perfluoroalkyl or perfluoroalkoxyperfluoroalkyl, $R_2$ denotes $C_3$–$C_4$-alkylene, $R_3$ denotes $C_2$–$C_5$-ω-epoxyalkyl or $C_1$–$C_{18}$ alkyl, which can be substituted by 1 or 2 halogen atoms by hydroxyl groups, by a group of the formula $$-(OCH_2\underset{R_4}{CH})_a-OR_5,$$

by 1 to 3 groups of the formula —OCO—CX=CY—COO—$(CH_2)_m$—$R_1$ or by, in each case, one lower alkoxy, epoxy, lower acyloxy, lower alkoxycarbonyl, lower acylamino, lower hydroxylalkylthio, lower trialkylamino, lower trialkylammonium, phenyl, phenoxy or furanyl group or $R_3$, in the case where b=0, also denotes $C_3$–$C_{18}$-alkenyl, which can be substituted by hydroxyl groups or a phenyl group; $C_3$–$C_8$-alkynyl, which can be substituted by hydroxyl groups; cyclohexyl; phenyl, which can be substituted by 1–3 $C_1$–$C_8$-alkyl groups or by phenyl, or naphthyl, $R_4$ denotes hydrogen or methyl, $R_5$ denotes hydrogen or $C_1$–$C_4$-alkyl, X and Y denote hydrogen, halogen or $C_1$–$C_6$-alkyl, a denotes a number from 1 to 10, b denotes 0 or 1 and m denotes a number from 1 to 6.

2. A perfluoroalkyl ester of the formula (1) as claimed in claim 1 wherein $R_1$ denotes a group of the formula $C_lF_{2l+1}$—, a group of the formula $H(C_2F_4)_n$—, or a group of the formula $(CF_3)_2CFO(CF_2)_o$—, l denotes the numbers 6, 8, 10, 12 and 14, n denotes the numbers 1, 2, 3 and 4 and o denotes whole numbers from 2 to 8, b=0, X and Y denote hydrogen atoms, and $R_3$ denotes straightchain or branched $C_2$—$C_8$-alkyl, which can be substituted by hydroxyl groups, chlorine atoms, 1 to 3 groups of the formula —OCO—CX=CY—COO—$(CH_2)_m$—$R_1$ or the epoxide group.

3. A perfluoroalkyl ester of the formula (1) as claimed in claim 1, wherein:

$R_1$ denotes $C_4$–$C_{14}$-perfluoroalkyl or perfluoroalkoxyperfluoroalkyl;

$R_3$ denotes said epoxyalkyl or $C_1$–$C_5$ alkyl, which can be substituted by hydroxy groups or by one or two chlorine atoms;

m denotes a number from 1 to 4.

4. A perfluoroalkyl ester of the formula (1) as claimed in claim 1, wherein X and Y denote hydrogen atoms arranged in trans-positions.

5. A perfluoroalkyl ester as claimed in claim 2, wherein X and Y denote hydrogens arranged in trans-positions.

6. A process for the preparation of a perfluoroalkyl ester of the formula (1) of claim 1 which comprises reacting 1 mole of maleic anhydride with 1 mole of a perfluorinated alcohol or alkoxyalcohol of the formula $$R_1-(CH_2)_m-OH,$$

chlorinating the thus-obtained hemiester of maleic acid, of fumaric acid, or of mixtures of these acids, and reacting the resulting acid chloride, in the presence of a base, with an alcohol of the formula $$HO-(\underset{OH}{R_2O})_b-R_3$$

or reacting the hemiester of maleic acid, of fumaric acid, or the mixture of said hemiesters with an epoxide, with resulting formation of a perfluoroalkyl β-hydroxyalkyl ester.

7. A method for providing oil- and water-repellant finishing of textile material comprising the step of applying a perfluoroalkyl ester of formula (1) of claim 1 to the textile material.

8. A method according to claim 7 wherein the said perfluoroalkyl ester is applied in an impregnation step.

* * * * *